US006475015B1

(12) United States Patent
Murakami et al.

(10) Patent No.: US 6,475,015 B1
(45) Date of Patent: Nov. 5, 2002

(54) HALF-FITTING PREVENTION CONNECTOR

(75) Inventors: Takao Murakami, Shizuoka (JP); Masaru Fukuda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/590,097

(22) Filed: Jun. 9, 2000

(30) Foreign Application Priority Data

Jun. 11, 1999 (JP) ..... 11-165538

(51) Int. Cl.[7] ..... H01R 13/627
(52) U.S. Cl. ..... 439/352; 439/489
(58) Field of Search ..... 439/488–489, 439/350–353

(56) References Cited

U.S. PATENT DOCUMENTS 5,643,003 A * 7/1997 Mayer et al. ..... 439/352
6,027,364 A * 2/2000 Fukuda ..... 439/489
6,095,843 A * 8/2000 Kaneko et al. ..... 439/352
6,171,130 B1 * 1/2001 Yoshida et al. ..... 439/352

FOREIGN PATENT DOCUMENTS

GB 2 324 209 A 10/1998
JP 5-81967 11/1993
JP 10-289756 10/1998

* cited by examiner

*Primary Examiner*—Tho D. Ta
*Assistant Examiner*—Larisa Z Tsukerman
(74) *Attorney, Agent, or Firm*—Sughrue Mion, PLLC

(57) ABSTRACT

In a half-fitting prevention connector (200), a slider (10) prevents a half-fitted condition of a pair of connectors by an urging force by compression springs (9) provided in a housing (3) of a male connector (1), and the slider is received in the housing. When the male connector is to be fitted relative to a female connector (2), the slider cooperates with the compression springs (9) to move between a lock position where the slider holds a lock arm (6), provided in the housing (3), in retained relation to a housing (21) of the female connector (2) and a non-lock position. The lock arm (6) has a lock projection (40) for retaining the slider (10) in the lock position against the urging force of the compression springs (9). A slanting surface for dissipating an impinging force of the slider (10) is formed on the lock projection (40) which can abut against an engagement portion (51) of the slider (10).

4 Claims, 9 Drawing Sheets

HALF-FITTING PREVENTION CONNECTOR

BACKGROUND OF THE INVENTION

1. Field of the Invention

The present invention relates to a half-fitting prevention connector in which a slider, mounted on at least one of a pair of connectors to be fittingly connected together, positively prevents a half-fitted condition of the two connectors by a resilient force of an urging member, and also the slider can positively lock the connector to the mating connector in a fitted condition.

The present application is based on Japanese Patent Application No. Hei. 11-165538, which is incorporated herein by reference.

2. Description of the Related Art

Usually, various electronic equipments are mounted on a vehicle such as an automobile, and therefore, naturally, various types of female and male connectors are provided at connection ends of various kinds of wires forming wire harnesses or the like.

Various half-fitting prevention connectors, capable of detecting a half-fitted condition of the female and male connectors, have been used, and one such half-fitting prevention connector is disclosed in Unexamined Japanese Utility Model Publication No. Hei. 5-81967.

This half-fitting prevention connector comprises a pin-type connector, having a plurality of juxtaposed pin contacts mounted therein, and a socket-type connector having a plurality of juxtaposed socket contacts mounted therein. A movable cover is mounted on the outer periphery of the female connector for movement back and forth. Spring receiving portions are provided at opposite side portions of this movable cover, respectively, and spring members are received respectively in these spring receiving portions, and extend in a forward-rearward direction.

In this half-fitting prevention connector, however, although a half-fitted condition can be prevented by the resilient force of the spring members, there is encountered a problem that when trying to fit the two connectors together while holding the opposite side surfaces of the movable cover with the hand, the movable cover can not be moved, and therefore the efficiency of the fitting operation is low.

Therefore, various half-fitting prevention connectors for solving the above problem have been proposed. FIGS. 6 to 9 show a half-fitting prevention connector 100 disclosed in Unexamined Japanese Patent Publication No. Hei. 10-289756.

As shown in FIG. 6, this half-fitting prevention connector 100 comprises a pair of male and female connectors 1A and 2 to be fittingly connected together.

The male connector 1A comprises a housing 3A which includes an inner housing 3*a* having terminal receiving chambers 17 for respectively receiving a predetermined number of (two in the illustrated example) socket contacts 31. A slider receiving portion 4 for slidably receiving a slider 10A (described later) is formed above the inner housing 3*a,* and an outer housing, serving as a hood portion 19, covers the outer periphery of the inner housing 3*a,* with a suitable space formed therebetween, the outer housing forming the slider receiving portion 4.

Side rib-receiving portions 19*a* for respectively receiving side ribs 27 (described later) of the female connector 2 are formed in an inner surface of the hood portion 19, and extend in a fitting direction.

Guide grooves 5 for respectively guiding opposite side portions of a slider body 11 are formed respectively at opposite side portions of the slider receiving portion 4, and tubular spring receiving portions 3*c* are formed respectively at rear ends of the guide grooves 5. A lock arm 6 of the cantilever type is formed integrally at a central portion of the slider receiving portion 4, and extends in the fitting direction, and a free end (distal end) portion of this lock arm 6 can be elastically displaced in an upward-downward direction.

A lock projection 7, having a slanting surface 7*b,* is formed on an upper surface of the lock arm 6, and a housing lock 8 for retaining engagement with a female housing 21 (described later) is formed on a lower surface of the lock arm 6 at the distal end thereof. Displacement prevention projections 8*a* for preventing the displacement of the lock arm 6 are formed integrally on the upper surface of the lock arm 6, and face away from the housing lock 8. Side spaces 4*a* for respectively receiving abutment projections 14 of the slider 10A (described later) are provided at opposite sides of the lock arm 6, respectively.

As shown in FIG. 10, the slider 10A has an elastic slider arm 12 of the cantilever type provided at a generally central portion of the slider body 11, and the pair of abutment projections 14 are formed respectively on opposite side portions of a lower surface of the slider arm 12 at a front end thereof. The slider 10A includes a pressing portion 15, which is operated when canceling the fitting connection, a slide groove 13 formed in the slider arm 12 and the pressing portion 15, and a pair of spring retaining portions 16 which are formed respectively at opposite side portions of a lower rear portion of the slider, and retain a pair of compression springs (spring members) 9 and 9, respectively.

As shown in FIG. 7, the female connector 2 includes terminal receiving chambers 29 (each in the form of a through hole) for respectively receiving a predetermined number of (two in the illustrated example) pin contacts 32, and this female connector has a housing insertion port 26 open to the front end thereof. A pair of stopper projections 22 are formed on the upper surface of the housing 21, and these projections 22 abut respectively against the abutment projections 14 of the slider 10A when the connectors are fitted together. An engagement projection 23 for retaining the housing lock 8 is formed between the stopper projections 22 and 22, and this engagement projection 23 has a slanting surface for flexing (elastically deforming) the lock arm 6 of the male connector 1A when the lock arm 6 is brought into engagement with the engagement projection 23. A bracket 28 for mounting on an associated member is formed on the housing 21, and is disposed at the lower side of the housing insertion port 26.

First, as shown in FIG. 7, when the slider 10A, having the compression springs 9 retained respectively by the spring retaining portions 16, is inserted into the slider receiving portion 4 from the front side of the male connector 1A, the slider body 11 is moved rearward along the guide grooves 5. At this time, the abutment projections 14, formed on the lower surface of the slider arm 12, are received respectively in the side spaces 4*a* provided respectively at the opposite sides of the lock arm 6.

Then, the compression springs 9 are received in the spring receiving portions 3*c,* respectively, and also the lock projection 7 is fitted in the slide groove 13, so that the slider 10A is supported on the housing 3A so as to move between a lock position and a non-lock position. In the non-lock position of the slider 10A, the slider 10A is disposed at a proximal end-side of the lock arm 6 to allow the elastic deformation of the lock arm 6 when the lock arm 6 is brought into and out of engagement with the mating housing. In the lock position, the slider 10A is disposed at a distal end-side of the lock arm 6 to prevent the elastic deformation of the lock arm 6.

In the slider-mounted condition, the slider 10A is urged forward (that is, to the lock position) by the resilient force of the compression springs 9 as shown in FIG. 7, and a rear end 13*a* of the slide groove 13 is engaged with the lock projection 7 in the slide groove 13, and also the displacement prevention projections 8*a* at the distal end of the lock arm 6 are abutted against a displacement prevention portion 11*a* of the slider 10A, thereby preventing upward elastic displacement of the lock arm 6.

Then, the socket contacts 31 are inserted respectively into the terminal receiving chambers 17 open to the rear end of the housing 3A of the male connector 1A, and these contacts 31 are retained respectively by housing lances formed respectively within the terminal receiving chambers 17. The pin contacts 32 are inserted respectively into the terminal receiving chambers 29 open to the rear end of the housing 21 of the female connector 2, and these contacts 32 are retained respectively by housing lances formed respectively within the terminal receiving chambers 29.

Then, when the male and female connectors 1A and 2 begin to be fitted together as shown in FIG. 8, the stopper projections 22 of the female connector 2 are inserted respectively into the side spaces 4*a* (see FIG. 6) provided respectively at the opposite sides of the lock arm 6 of the male connector 1A, and these stopper projections 22 abut respectively against the abutment projections 14 of the slider 10A, and when the female connector 2 is pushed, the compression springs 9 are compressed to produce a resilient force.

Then, when the fitting operation further proceeds, the slider 10A is pushed rearward (right in FIG. 8) against the bias of the compression springs 9, and the housing lock 8 at the distal end of the lock arm 6 engages the engagement projection 23 of the female connector 2. If the pushing operation is stopped in this half-fitted condition, the male and female connectors 1A and 2 are pushed back away from each other in their respective disengaging directions (opposite to their respective fitting directions) by the resilient force of the compression springs 9, so that this half-fitted condition can be easily detected.

Then, when the fitting operation further proceeds as shown in FIG. 9, the slider arm 12 of the slider 10A is elastically deformed upwardly by the slanting surface 7*b* of the lock projection 7, so that the abutting engagement of each stopper projection 22 with the associated abutment projection 14 of the slider 10A is canceled. Then, the housing lock 8 at the distal end of the lock arm 6 slides over the engagement projection 23, and is retained by this projection 23 while the slider arm 12, disengaged from the stopper projections 22, is returned to the lock position by the resilient force of the compression springs 9.

When the slider 10A is returned to the lock position by the resilient force of the compression springs 9, the displacement prevention portion 11*a* of the slider 10 abuts against the displacement prevention projections 8*a* of the lock arm 6, as shown in FIG. 9. Therefore, the elastic deformation of the lock arm 6 is prevented, thus achieving a double-locked condition in which the cancellation of the engagement between the lock arm 6 and the engagement projection 23 is prevented by the slider 10A. In this condition in which the cancellation of the engagement of the lock arm 6 is prevented by the slider 10A, the male and female connectors are in a completely-fitted condition, and the contacts 31 are completely connected to the contacts 32, respectively.

This completely-fitted condition can be detected through the sense of touch obtained when the housing lock 8 slides over the engagement projection 23, and also this completely-fitted condition can be easily confirmed by viewing the position of the returned slider 10A.

In the above conventional half-fitting prevention connector 100, when the slider 10 is returned to the lock position, an abutment surface 7*a* of the lock projection 7, formed on the lock arm 6, abuts against the rear end 13*a* of the slide groove 13 in the slider 10A, thereby limiting the forward displacement of the slider 10A, as shown in FIG. 9.

Therefore, all of the resilient forces of the compression springs 9 serve as a force F of impingement of the slider 10A on the lock projection 7 on the housing 3A. Therefore, there have been encountered problems that the excessive force acts on the lock projection 7, and that a large impingement sound and impact vibration due to the impingement of the slider 10A on the lock projection 7 are produced when the slider 10A is returned, which is unpleasant.

SUMMARY OF THE INVENTION

It is therefore an object of the present invention to provide an improved half-fitting prevention connector in which undue impingement of a slider on a housing is prevented at the time of returning movement of the slider, thereby reducing unpleasant impingement sound and impact vibration due to the impingement.

To achieve the above object, according to the first aspect of the present invention, there is provided a half-fitting prevention connector which comprises a first connector housing having a lock arm formed therein, the lock arm including a lock projection, a second connector housing fittable to the first connector housing, an urging member attachable into the first connector housing, the urging member producing an urging force in a fitting-canceling direction between the first and second connector housings, a slider insertable into the first connector housing, the slider preventing a half-fitted condition of the first and second connector housings by the urging force of the urging member, wherein when the first and second connector housings are fitted to each other, the slider cooperates with the urging member to move between a lock position where the slider holds the lock arm in retained relation to the second connector housing and a non-lock position, and the lock projection of the lock arm retains the slider in the lock position against the urging force of the urging member, and a slanting surface formed on at least one of an engagement portion of the slider and the lock projection which can abut against each other, in order to dissipate an impinging force of the slider with the lock projection.

In the above construction, when the slider is returned from the non-lock position to the lock position by the urging force of the urging member in the connector-fitting operation, the engagement portion of the slider impinges on the lock projection on the lock arm, and an impinging force, developing at this time in the direction of movement of the slider, is dissipated by the slanting surface into a perpendicular drag and a frictional force.

Therefore, the impinging force, produced upon impingement of the engagement portion of the slider on the lock projection, is weakened by the slanting surface, and an excessive force is prevented from acting on the lock projection, and also impingement sound and impact vibration due to the impingement are reduced.

Further, according to the second aspect of the present invention, the slanting surface may be formed on the lock projection of the lock arm.

Further, according to the third aspect of the present invention, an overhang portion may be formed on an upper end of the slanting surface. The overhang portion serves to prevent the engagement portion of the slider from sliding over the slanting surface out of engagement with the lock projection.

DETAILED DESCRIPTION OF THE PREFERRED EMBODIMENT

One preferred embodiment of a half-fitting prevention connector of the present invention will now be described in detail with reference to FIGS. 1 to 5.

Figure 6:
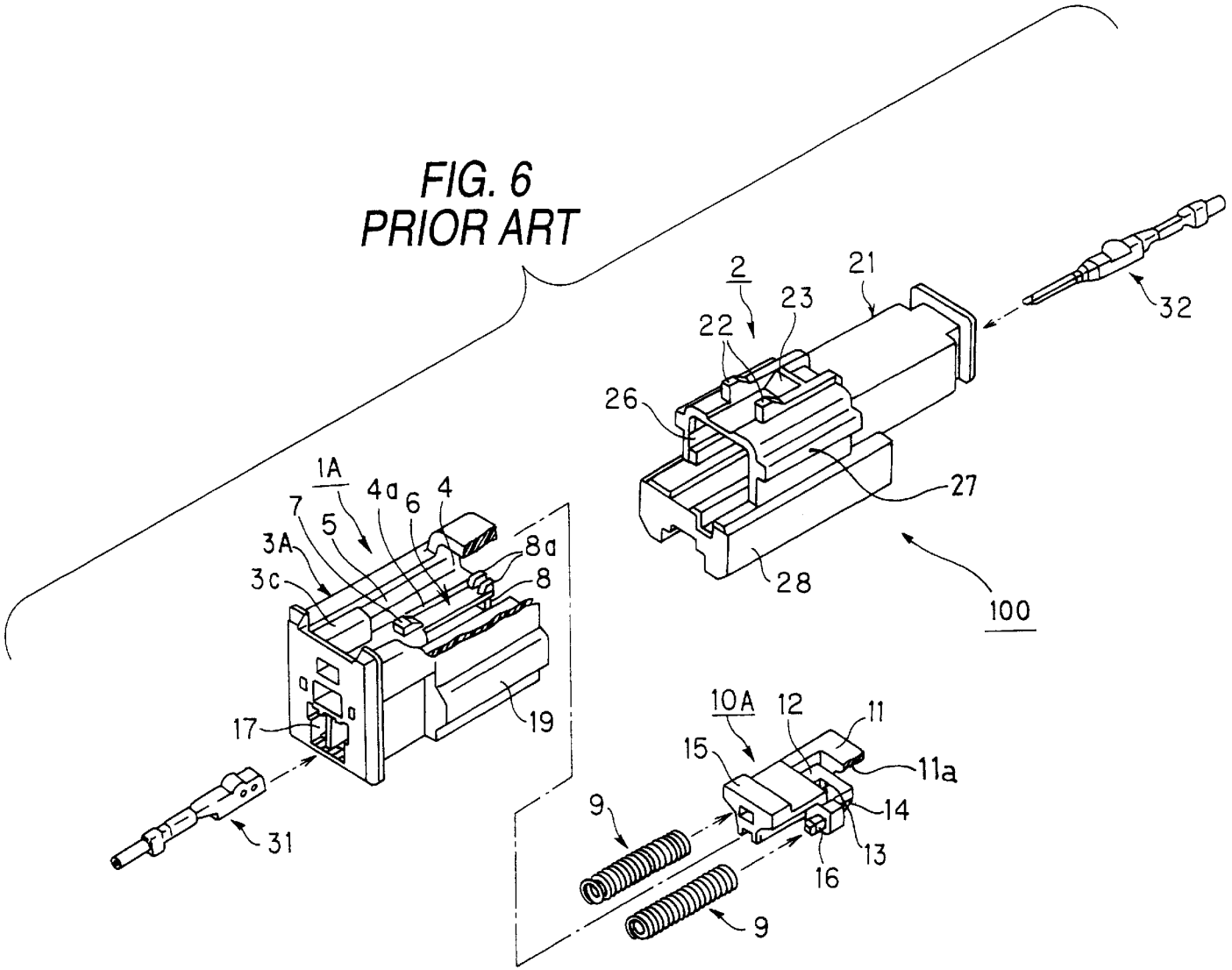
FIG. 6 PRIOR ART
FIG. 6 is an exploded, perspective view of a conventional half-fitting prevention connector.
Figure 7:
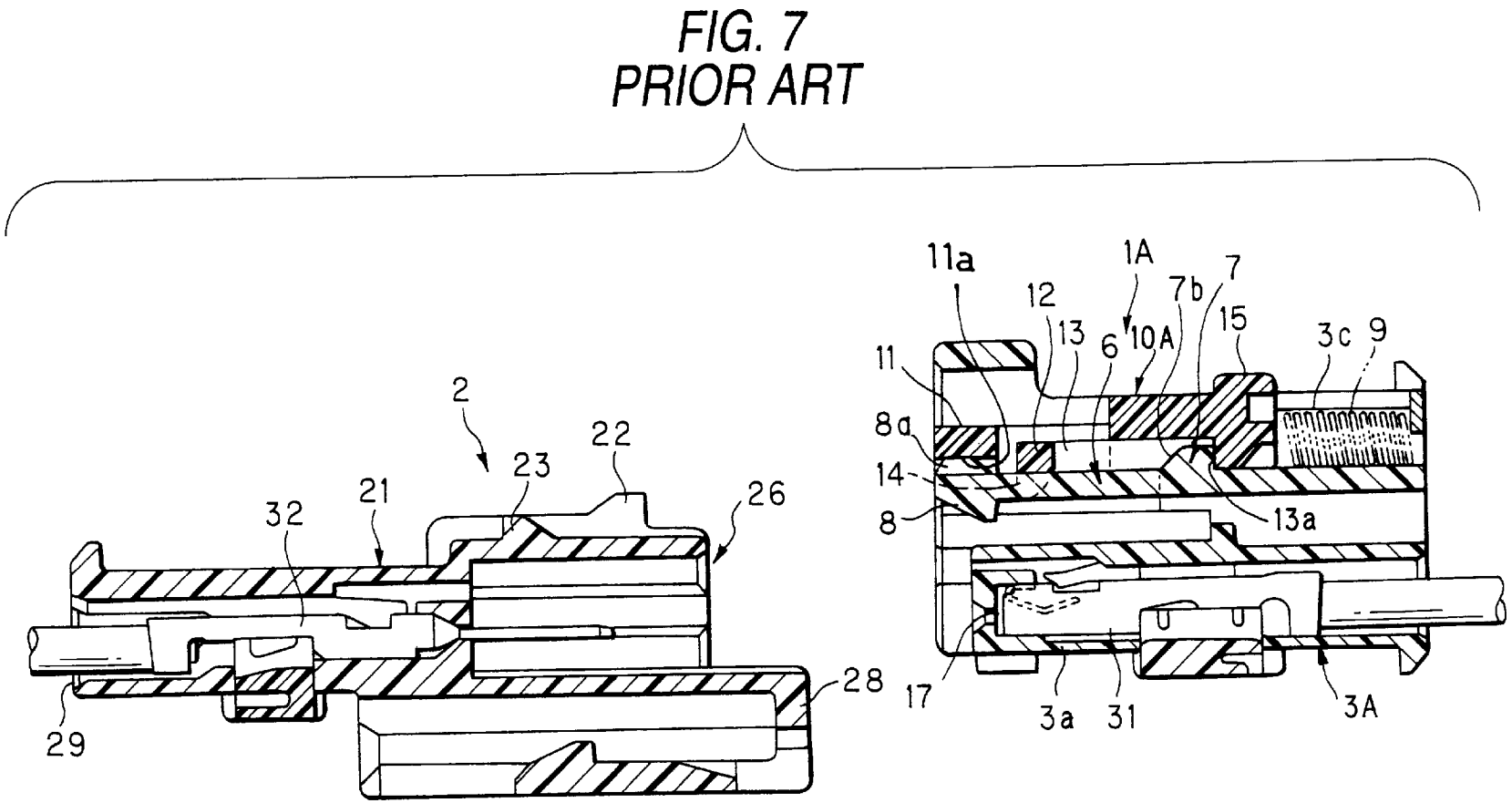
FIG. 7 PRIOR ART
FIG. 7 is a vertical cross-sectional views showing the procedure of assembling the half-fitting prevention connector of FIG. 6.
Figure 8:
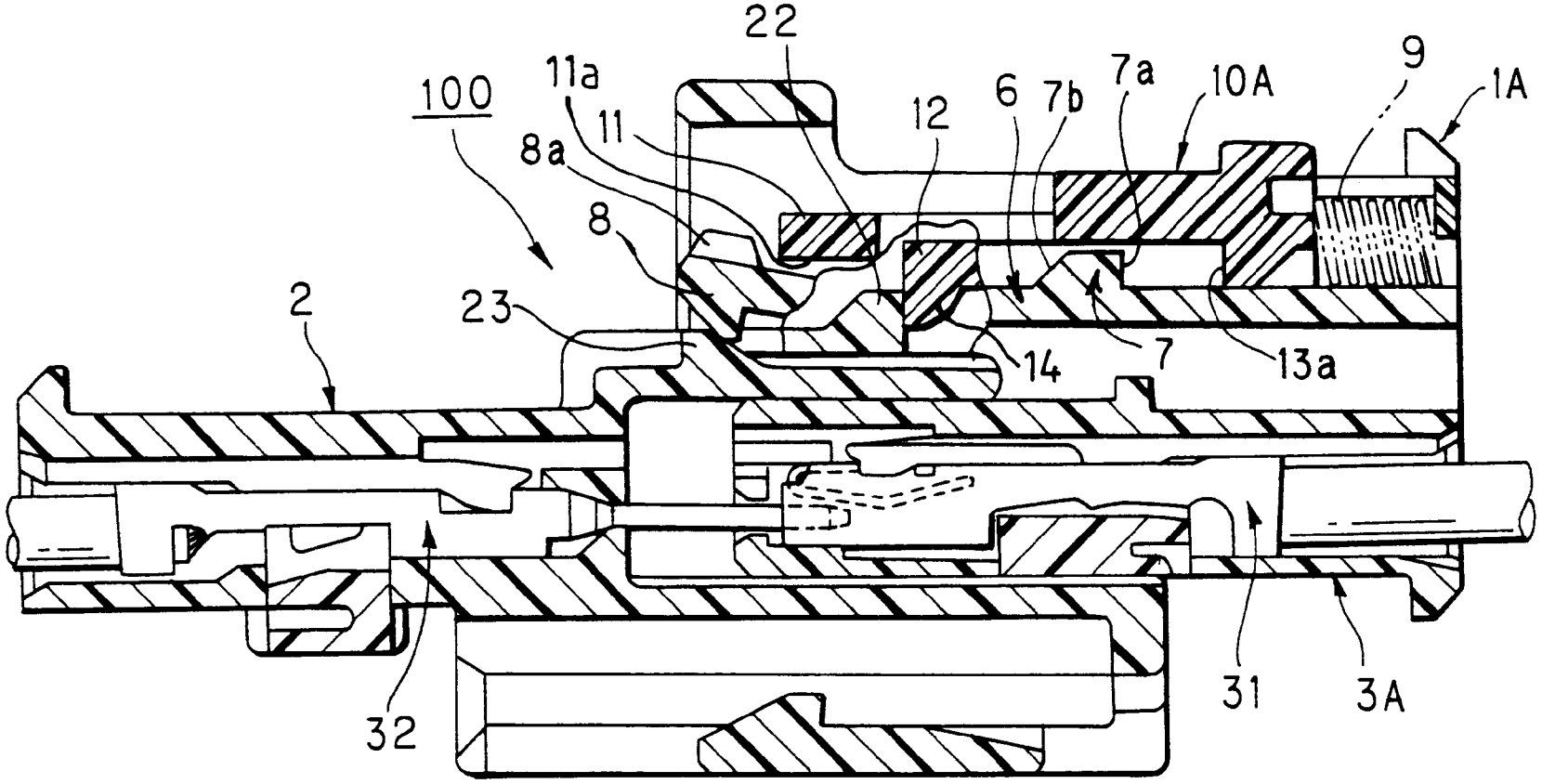
FIG. 8 PRIOR ART
FIG. 8 is a vertical cross-sectional view of the half-fitting prevention connector of FIG. 6 in a half-fitted condition.
Figure 9:
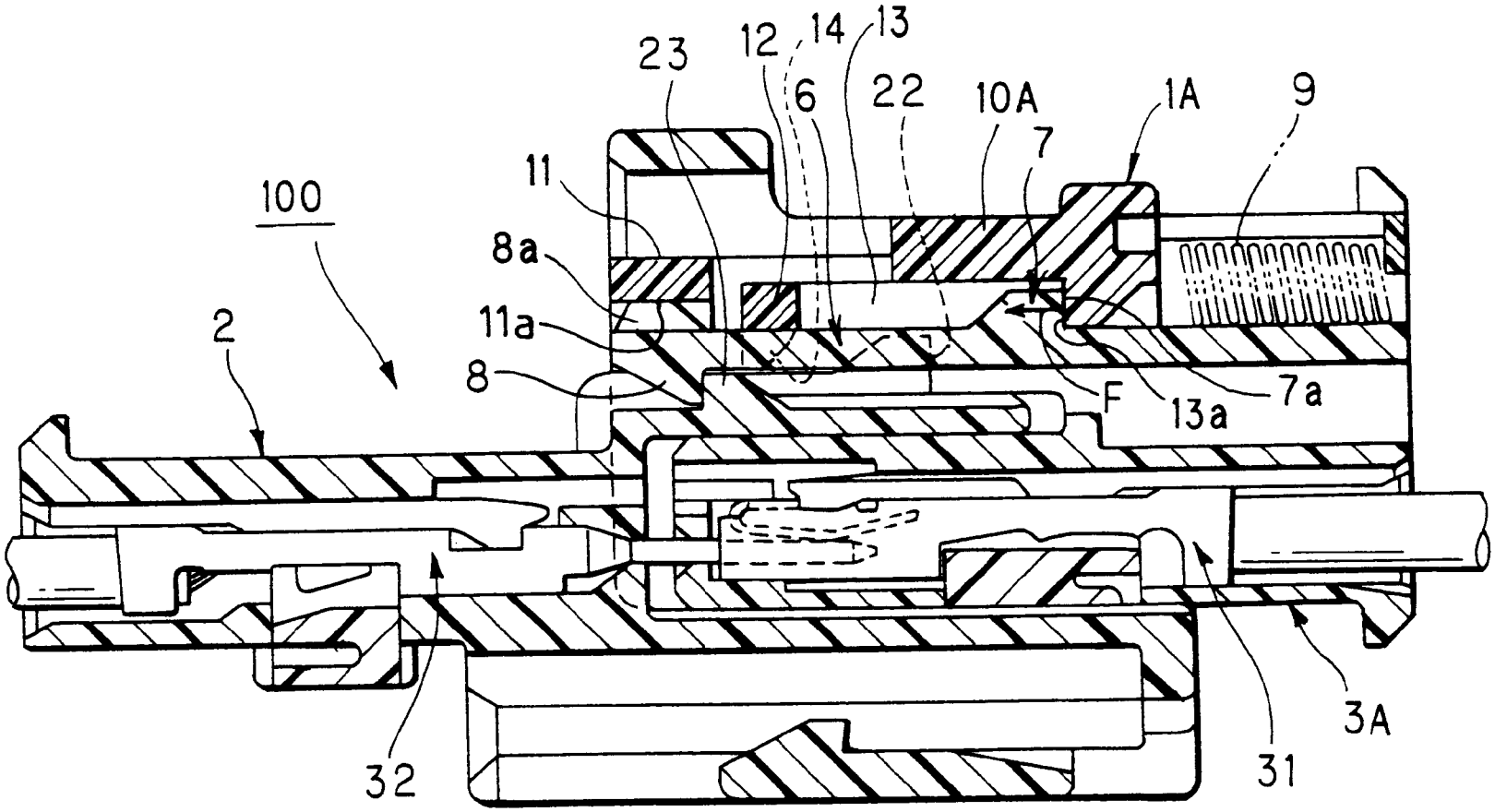
FIG. 9 PRIOR ART
FIG. 9 is a vertical cross-sectional view of the half-fitting prevention connector of FIG. 6 in a completely-fitted condition.

Like the half-fitting prevention connector 100 of FIG. 6, the half-fitting prevention connector 200 of this embodiment comprises a pair of male and female connectors 1 and 2 to be fittingly connected together.

Figure 1:
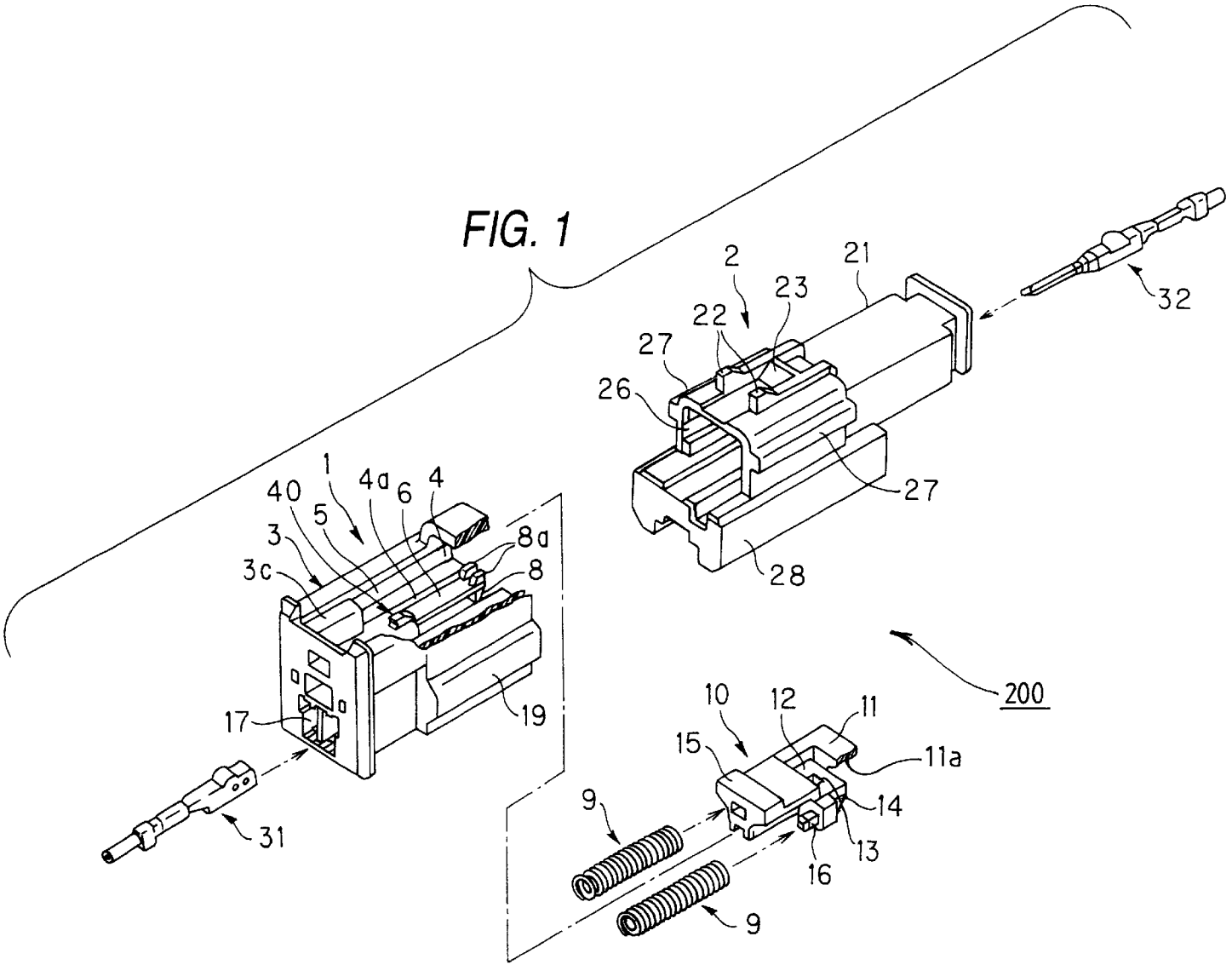
FIG. 1 is an exploded, perspective view of one preferred embodiment of a half-fitting prevention connector of the present invention.

As shown in FIG. 1, the male connector 1 comprises a housing 3 which includes an inner housing 3*a* having terminal receiving chambers 17 for respectively receiving a predetermined number of (two in the illustrated example) socket contacts 31. A slider receiving portion 4 for slidably receiving a slider 10 is formed above the inner housing 3*a,* and an outer housing, serving as a hood portion 19, covers the outer periphery of the inner housing 3*a,* with a suitable space formed therebetween, the outer housing forming the slider receiving portion 4.

Figure 2:
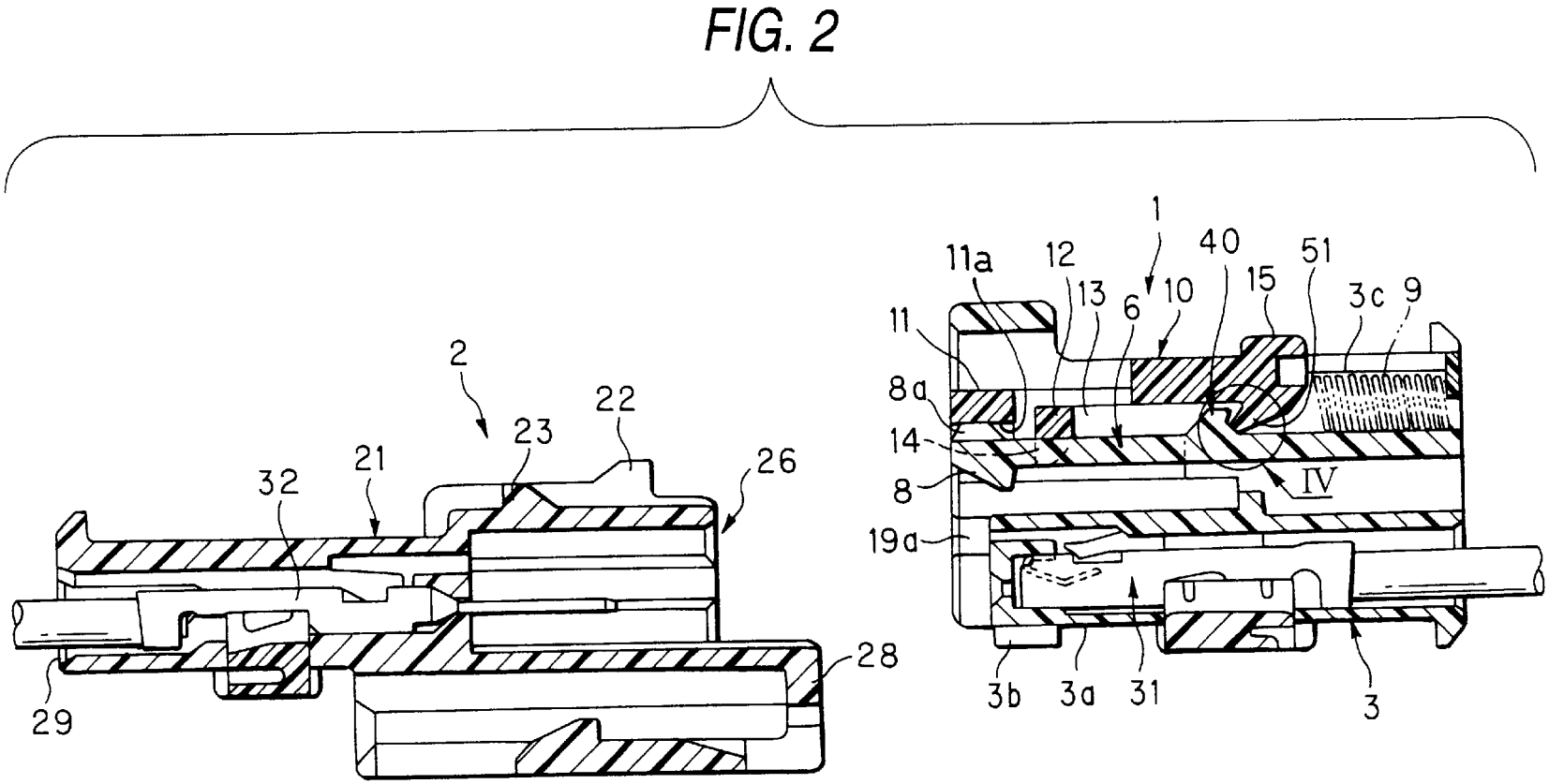
FIG. 2 is a vertical cross-sectional views showing the procedure of assembling the half-fitting prevention connector of FIG. 1.

As shown in FIG. 2, side rib-receiving portions 19*a* for respectively receiving side ribs 27 (described later) of the female connector 2 are formed in an inner surface of the hood portion 19, and extend in a fitting direction.

Guide grooves 5 for respectively guiding opposite side portions of a slider body 11 are formed respectively at opposite side portions of the slider receiving portion 4, and tubular spring receiving portions 3*c* are formed respectively at rear ends of the guide grooves 5. A lock arm 6 of the cantilever type is formed integrally at a central portion of the slider receiving portion 4, and extends in the fitting direction, and a free end (distal end) portion of this lock arm 6 can be elastically displaced in an upward-downward direction.

A lock projection 40 is formed on an upper surface of the lock arm 6, and a housing lock 8 for retaining engagement with a female housing 21 is formed on a lower surface of the lock arm 6 at the distal end thereof. Displacement prevention projections 8*a* for preventing the displacement of the lock arm 6 are formed integrally on the upper surface of the lock arm 6, and face away from the housing lock 8. Side spaces 4*a* for respectively receiving abutment projections 14 of the slider 10 are provided at opposite sides of the lock arm 6, respectively.

As shown in FIGS. 1 and 2, the slider 10 has an, elastic slider arm 12 of the cantilever type provided at a generally central portion of the slider body 11, and the pair of abutment projections 14 are formed respectively on opposite side portions of a lower surface of the slider arm 12 at a front end thereof. The slider 10 includes a pressing portion 15, which is operated when canceling the fitting connection, a slide groove 13 formed in the slider arm 12 and the pressing portion 15, an engagement portion 51 provided at a rear end of the slide groove 13, and a pair of spring retaining portions 16 which are formed respectively at opposite side portions of a lower rear portion of the slider, and retain a pair of compression springs (spring members) 9 and 9, respectively.

The female connector 2, shown in FIG. 1, is totally identical in construction to the female connector 2 of the half-fitting prevention connector 100 of FIG. 6, and therefore the corresponding portions will be designated by identical reference numerals, respectively, and detailed description thereof will be omitted.

Figure 3:
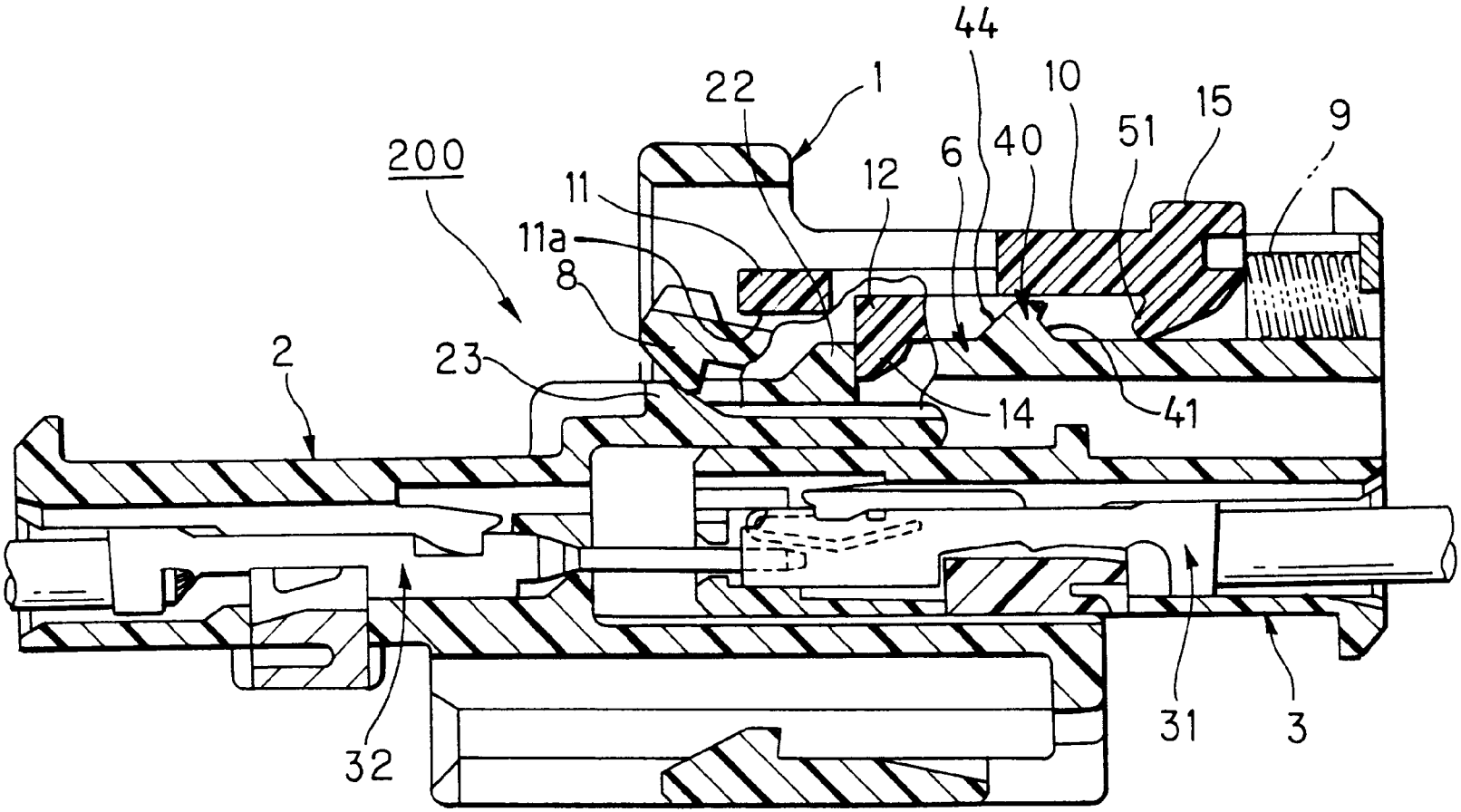
FIG. 3 is a vertical cross-sectional views showing the procedure of assembling the half-fitting prevention connector of FIG. 1.

As shown in FIG. 3, the lock projection 40 includes an abutment surface 41 for limiting the forward displacement of the slider 10 against the bias of the compression springs (urging member) 9 and 9 to retain the slider 10 in a lock position, and a slanting surface 44 for upwardly flexing (elastically deforming) the slider arm 12 so as to cancel the engagement of each abutment projection 14 of the slider 10 with the associated stopper projection 22.

Figure 4:
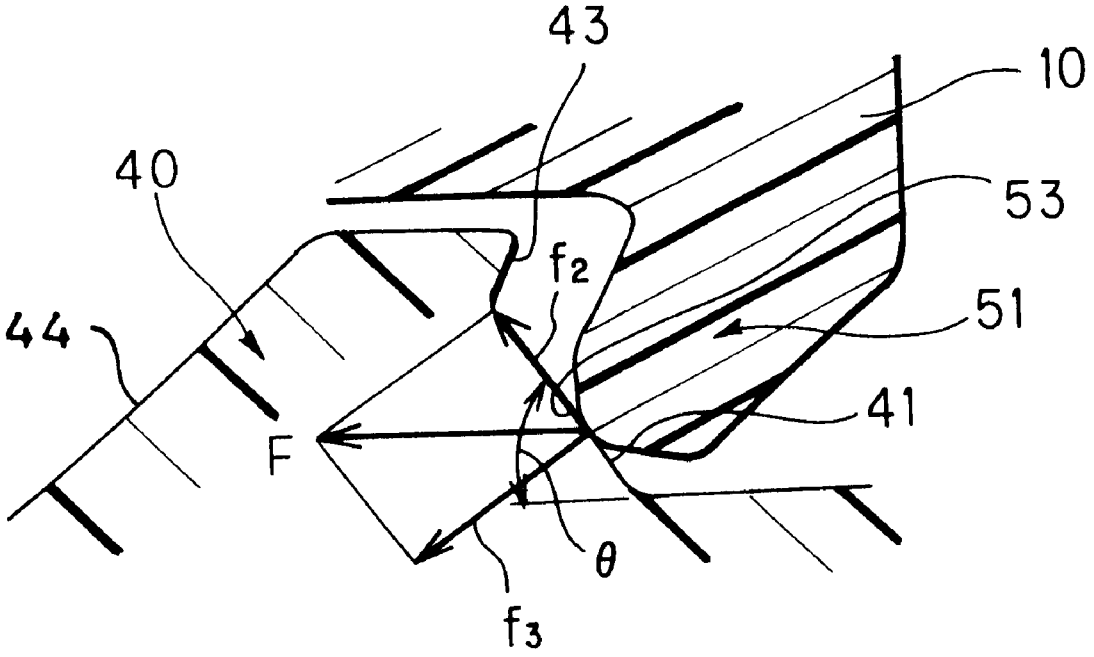
FIG. 4 is an enlarged view of a portion IV of FIG. 2.

As shown in FIG. 4, the abutment surface 41 for abutting engagement with the an engagement surface 53 of engagement portion 51 of the slider 10 is formed into a slanting surface for dissipating an impinging force of the slider 10, and has an angle θ of inclination with respect to the upper surface of the lock arm 6. Furthermore, engagement surface 53 maintains an angle of inclination with respect to abutment surface 41 on both sides of the contact point. In other words, engagement surface 53 directly contacts abutment surface 41 at one point while maintaining an angle of inclination with respect to abutment surface 41 on either side thereof when in an engaged position. An overhang portion 43 is formed at an upper end of the abutment surface 41, and this overhang portion 43 serves to prevent the engagement portion 51, abutted against the abutment surface 41, from sliding over the abutment surface 41 out of engagement with the lock projection 40.

First, when the slider 10, having the compression springs 9 retained respectively by the spring retaining portions 16, is inserted into the slider receiving portion 4 from the front side of the male connector 1, the slider body 11 is moved rearward along the guide grooves 5, and the abutment projections 14, formed on the lower surface of the slider arm 12, are received respectively in the side spaces 4*a* provided respectively at the opposite sides of the lock arm 6.

Then, the compression springs 9 are received in the spring receiving portions 3*c,* respectively, and also the lock projection 40 is fitted in the slide groove 13, so that the slider 10 is supported on the housing 3 so as to move between the lock position and a non-lock position. In the non-lock position of the slider 10, the slider 10 is disposed at the proximal end-side of the lock arm 6 to allow the elastic deformation of the lock arm 6 when the lock arm 6 is brought into and out of engagement with the mating housing. In the lock position, the slider 10 is disposed at the distal end-side of the lock arm 6 to prevent the elastic deformation of the lock arm 6.

In the slider-mounted condition, the slider 10 is urged forward (that is, to the lock position) by the resilient force of the compression springs 9 as shown in FIG. 2, and the engagement portion 51 of the slider 10 is retained by the lock projection 40 in the slide groove 13, and also the displacement prevention projections 8*a* at the distal end of the lock arm 6 are abutted against a displacement prevention portion 11*a* of the slider 10, thereby preventing upward elastic displacement of the lock arm 6.

Then, when the male and female connectors 1 and 2 begin to be fitted together as shown in FIG. 3, the stopper projections 22 of the female connector 2 are inserted respectively into the side spaces 4*a* (see FIG. 1) provided respectively at the opposite sides of the lock arm 6 of the male connector 1, and these stopper projections 22 abut respectively against the abutment projections 14 of the slider 10, and when the female connector 2 is pushed, the compression springs 9 are compressed to produce a resilient force.

Then, when the fitting operation further proceeds, the slider 10 is pushed rearward (right in FIG. 3) against the bias of the compression springs 9, and the housing lock 8 at the distal end of the lock arm 6 engages an engagement projection 23 of the female connector 2. If the pushing operation is stopped in this half-fitted condition, the male and female connectors 1 and 2 are pushed back away from each other in their respective disengaging directions (opposite to their respective fitting directions) by the resilient force of the compression springs 9, so that this half-fitted condition can be easily detected.

Then, when the fitting operation further proceeds, the slider arm 12 of the slider 10 is elastically deformed upwardly by the slanting surface 44 of the lock projection 40, so that the abutting engagement of each stopper projection 22 with the associated abutment projection 14 of the slider 10 is canceled. Then, the housing lock 8 at the distal end of the lock arm 6 slides over the engagement projection 23, and is retained by this projection 23 while the slider arm 12, disengaged from the stopper projections 22, is returned to the lock position by the resilient force of the compression springs 9.

At this time, when the slider 10 is returned to the lock position, the engagement surface 53 of the engagement portion 51 impinges on the abutment surface 41 of the lock projection 40 formed on the lock arm 6, and an impinging force F, developing at this time in the direction of movement of the slider, is dissipated by the abutment surface (slanting surface) 41 into a perpendicular drag (force perpendicular to the abutment surface 41) $f_3$ and a frictional force (force acting along the abutment surface 41) $f_2$.

Therefore, the impinging force, produced upon impingement of the engagement surface 53 of the engagement portion 51 of the slider 10 on the lock projection 40, is weakened by the abutment surface (slanting surface) 41, and an excessive force is prevented from acting on the lock projection 40, and also impingement sound and impact vibration due to the impingement are reduced.

In this embodiment, the overhang portion 43 is formed at the upper end of the abutment surface 41, and this overhang portion 43 serves to prevent the engagement portion 51, abutted against the abutment surface 41, from sliding over the abutment surface 41 out of engagement with the lock projection 40. However, the provision of this overhang portion 43 is not essential, and can be omitted by optimizing the height of projecting of the lock projection 40 and a clearance over the slider 10.

Figure 5:
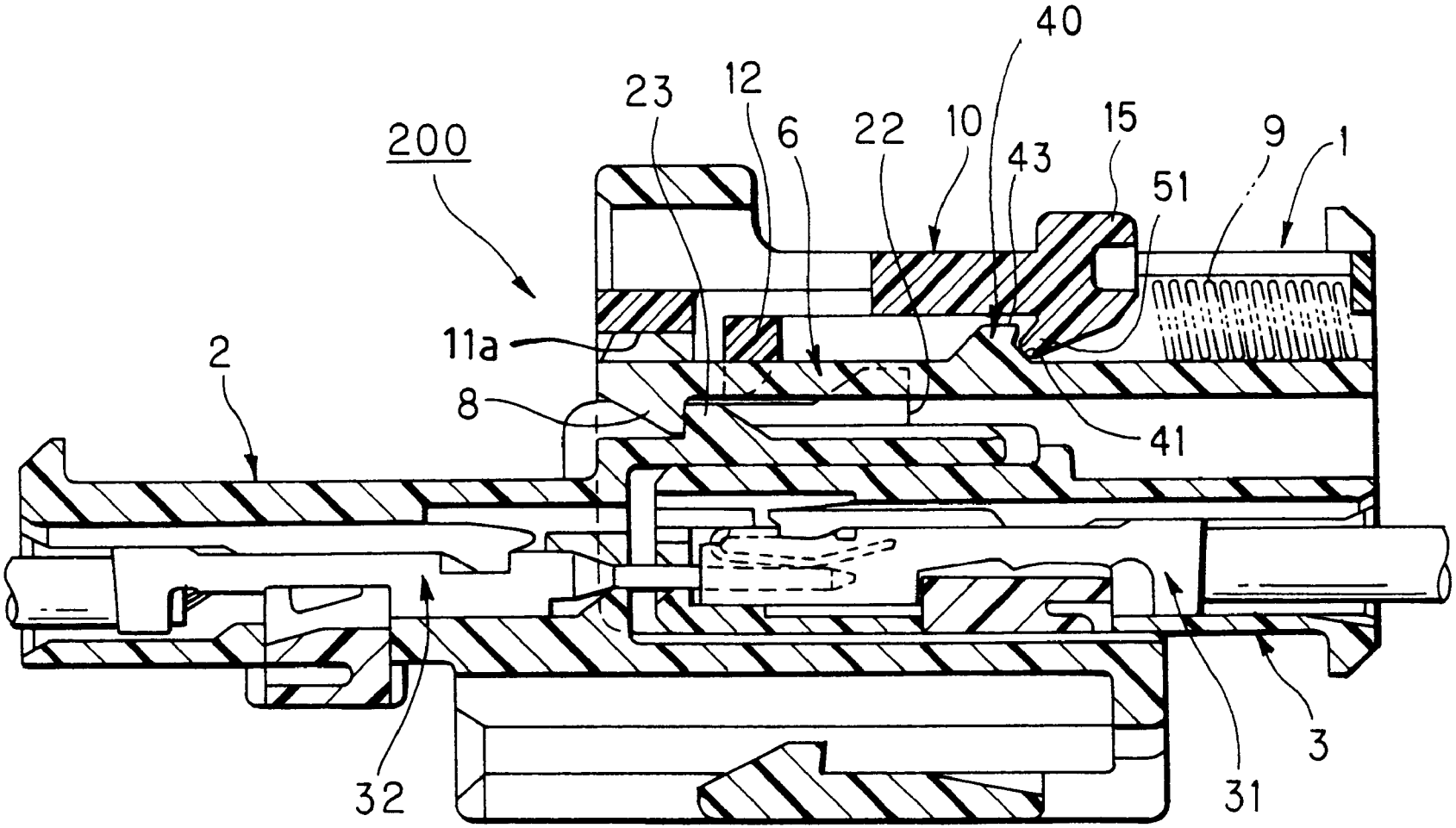
FIG. 5 is a vertical cross-sectional showing the half-fitting prevention connector of FIG. 1 in a completely-fitted condition.

Thus, the engagement portion 51 of the slider 10 abuts against the abutment surface 41 of the lock projection 40, and hence is prevented from forward displacement as shown in FIG. 5, and the fitting connection between the male and female connectors 1 and 2 is completed.

Therefore, in the half-fitting prevention connector 200 of this embodiment, all of the force of the compression springs 9 to return the slider 10 in the fitting operation does not serve as the force F of impingement of the slider 10 on the lock projection 40 of the housing 3, and therefore an excessive force will not act on the lock projection 40, and a large impingement sound and impact vibration due to the impingement of the slider 10 on the lock projection 40 will not be produced when the slider 10 is returned.

In the half-fitting prevention connector of the present invention, the housings, the slider, the lock projection and so on are not limited to their respective constructions of the above embodiment, and various modifications can be made without departing from the scope of the present invention.

For example, in the above embodiment, although the abutment surface 41 of the lock projection 40 is formed into the slanting surface having the acute inclination angle θ with respect to the upper surface of the lock arm 6, the abutment surface can be formed into a overhanging slanting surface having an obtuse inclination angle θ. In this case, the engagement portion, when impinges on the abutment surface, can slide toward the proximal end of the lock projection, and therefore will not become disengaged from the lock projection.

In the above embodiment, although the abutment surface 41 of the lock projection 40 is formed into the slanting surface, there may be used an arrangement in which the engagement portion of the slider is formed into a slanting surface while a smooth sliding-contact surface of an arcuate cross-section is formed at the distal end of the lock projection, or there may be used an arrangement in which slanting surfaces are formed on the engagement portion of the slider and the lock projection, respectively.

In the half-fitting prevention connector of the present invention, when the slider is returned from the non-lock position to the lock position by the urging force of the urging member in the connector-fitting operation, the engagement portion of the slider impinges on the lock projection on the lock arm, and an impinging force, developing at this time in the direction of movement of the slider, is dissipated by the slanting surface into a perpendicular drag and a frictional force.

Therefore, the impinging force, produced upon impingement of the engagement portion of the slider on the lock projection, is weakened by the slanting surface, and an excessive force is prevented from acting on the lock projection, and also impingement sound and impact vibration due to the impingement are reduced.

Therefore, there can be provided the improved half-fitting prevention connector in which undue impingement of the slider on the housing is prevented at the time of returning movement of the slider, thereby reducing unpleasant impingement sound and impact vibration due to the impingement.

What is claimed is:

1. A half-fitting prevention connector, comprising:

a first connector housing having a lock arm formed therein, the lock arm including a lock projection;

a second connector housing fittable to the first connector housing;

an urging member attachable into the first connector housing, the urging member producing an urging force in a fitting-canceling direction between the first and second connector housings;

a slider insertable into the first connector housing, the slider preventing a half-fitted condition of the first and second connector housings by the urging force of the urging member, wherein when the first and second connector housings are fitted to each other, the slider cooperates with the urging member to move between a lock position where the slider holds the lock arm in a retained relation to the second connector housing and a non-lock position, and the lock projection of the lock arm retains the slider in the lock position against the urging force of the urging member; and a slanting surface formed on at least one of an engagement portion of the slider and the lock projection which abut against each other when said slider is in said lock position, in order to dissipate an impinging force of the slider with the lock projection, and wherein said engagement portion includes a first surface and said lock projection includes a second surface, and, wherein said first and second surfaces directly contact each other and are inclined with respect to each other.

2. A half-fitting prevention connector according to claim 1, wherein the slanting surface is formed on the lock projection of the lock arm.

3. A half-fitting prevention connector according to claim 2, further comprising an overhang portion formed on an upper end of the slanting surface, the overhang portion preventing the engagement portion of the slider from sliding over the slanting surface out of engagement with the lock projection.

4. The half-fitting prevention connector of claim 1, wherein said first and second surface are in direct contact with each other when said connector is in an engaged position.

* * * * *